US010252316B2

(12) United States Patent
Grewe

(10) Patent No.: US 10,252,316 B2
(45) Date of Patent: Apr. 9, 2019

(54) ADJUSTABLE DIE

(71) Applicant: Douglas William Grewe, Anna, OH (US)

(72) Inventor: Douglas William Grewe, Anna, OH (US)

(73) Assignee: LOCHARD, INC., Sidney, OH (US)

( * ) Notice: Subject to any disclaimer, the term of this patent is extended or adjusted under 35 U.S.C. 154(b) by 180 days.

(21) Appl. No.: 15/205,033

(22) Filed: Jul. 8, 2016

(65) Prior Publication Data

US 2018/0009020 A1 Jan. 11, 2018

(51) Int. Cl.
*B21D 37/02* (2006.01)
*B21D 5/00* (2006.01)

(52) U.S. Cl.
CPC ..... *B21D 37/02* (2013.01); *B21D 5/00* (2013.01)

(58) Field of Classification Search
CPC ..... B21D 7/06; B21D 37/02; B21D 37/20; B21D 37/04; B21D 37/08; B21D 37/14; B21D 5/0227
See application file for complete search history.

(56) References Cited

U.S. PATENT DOCUMENTS 8,640,520 B2 * 2/2014 Lee ..... B21D 7/06 72/347

OTHER PUBLICATIONS

"Press Brakes/Wila Multi-V Die (Manually Adjustable)"; on-line video presentation offered by JMT USA; https://www.youtube.com/watch?v=zblSTjgBYK4; uploaded Aug. 28, 2012. CD containing the video presentation provided herewith.
"VLM—Adjustable die"; TRUMPF Tool Catalog, TRUMPF LASERdur Bending Toods; pp. 179-180 (Mar. 2016).
"Adjustable Bottom Tools (Multi-V and MVM)"; Press Brake Productivity Catalog; Custom Style Tooling; WILA; pp. 48-49 (May 2011).
"Adjustable Die and Replaceable Shoulder Die"; Wilson American Precision; Press Brake Solutions; http://www.wilsontool.com/Resources/Images/487.pdf; p. 51 (first publication at least as early as Mar. 2012).

* cited by examiner

*Primary Examiner* — Pradeep C Battula
(74) *Attorney, Agent, or Firm* — Thompson Hine LLP

(57) ABSTRACT

A die including a first support having a plurality of panels with adjacent ones of the panels defining a gap therebetween, and a second support having a plurality of panels with adjacent ones of the panels defining a gap therebetween. The first and second supports are configured to be interleaved by positioning at least one panel of each support within one of the gaps of the other support. The first and second supports are positionable in an interleaved configuration in a plurality of different positions relative to each other. The die further includes a coupling component configured to engage at least one of the supports to couple the at least one support to an underlying surface when the first and second supports are in one of the plurality of different positions.

21 Claims, 5 Drawing Sheets

ADJUSTABLE DIE

The present invention is directed to a die, and more particularly, to a die that is adjustable to vary the configuration of the die.

BACKGROUND

Dies are commonly used to provide an adjustable support when bending or forming a workpiece, or for other purposes. Some dies have a central opening and are adjustable such that the size of the opening can be varied to adjust for differing forming operations and/or accommodate workpieces of differing shapes and sizes. However, many existing dies utilize tools and/or shims to adjust the die, which can be time consuming, and requires additional parts which may not always be available or on-hand.

SUMMARY

In one embodiment, the invention is a die which can be easily and securely adjusted without the need for tools, shims or the like. More particularly, in one embodiment the invention is a die including a first support having a plurality of panels with adjacent ones of the panels defining a gap therebetween, and a second support having a plurality of panels with adjacent ones of the panels defining a gap therebetween. The first and second supports are configured to be interleaved by positioning at least one panel of each support within one of the gaps of the other support. The first and second supports are positionable in an interleaved configuration in a plurality of different positions relative to each other. The die further includes a coupling component configured to engage at least one of the supports to couple the at least one support to an underlying surface when the first and second supports are in one of the plurality of different positions.

DETAILED DESCRIPTION

Figure 1:
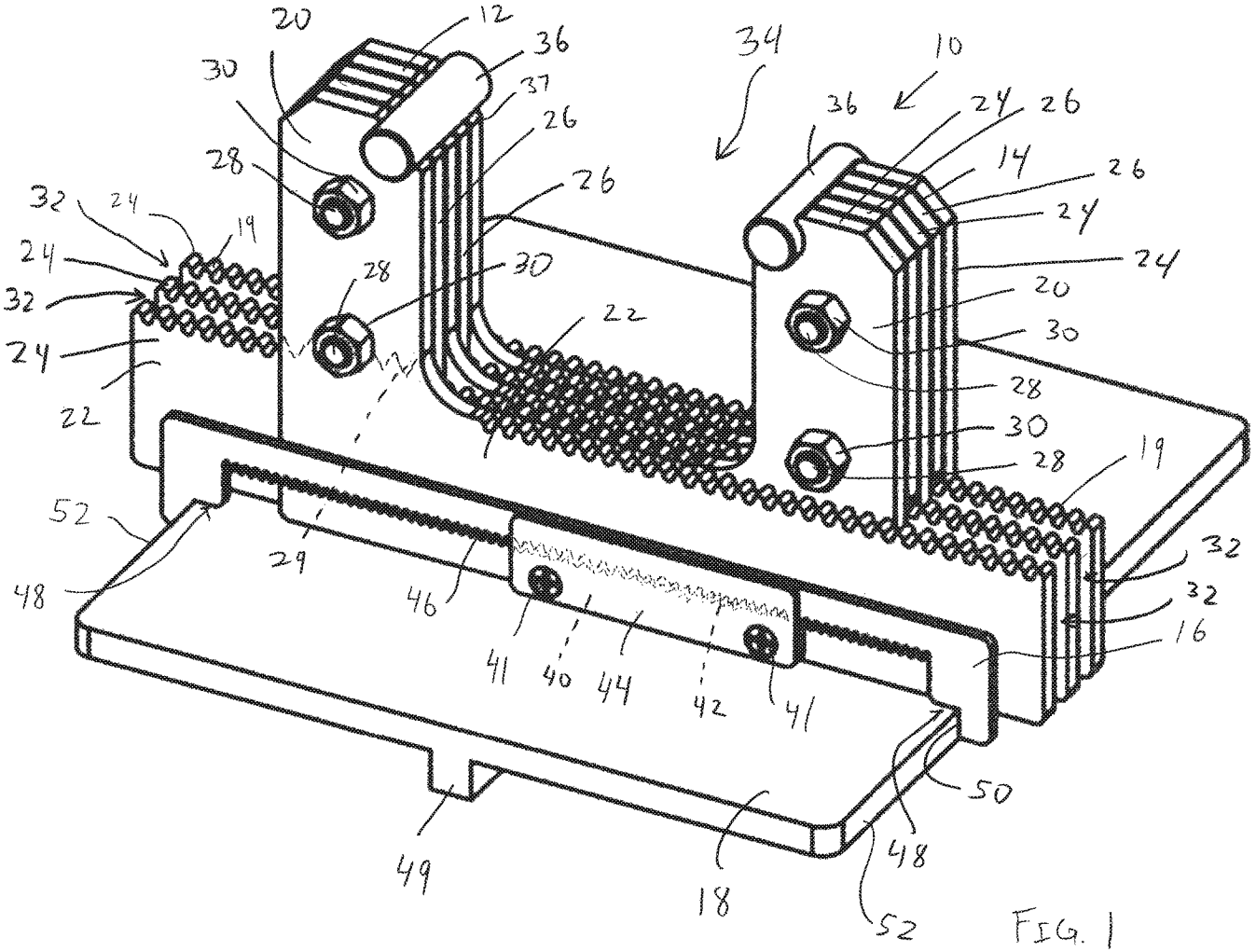
FIG. 1 is an upper perspective view of one embodiment of the adjustable die of the present invention.

As shown in FIGS. 1-7, the die or die system of the present invention, generally designated 10, can include a first support 12, a second support 14, and at least one coupling component 16 which is releasably securable to one or both supports 12, 14. The system 10 can also include an underlying surface 18, shown in the form of a plate 18. The supports 12, 14 can be releasably attachable together and/or the coupling component 16 and/or supports 12, 14 can be releasably attachable to the plate 18.

Each support 12, 14 can be identically configured and generally "L" shaped in side view (or reverse "L" shaped in side view, depending upon its orientation). Each support 12, 14 has a riser portion 20, which is oriented generally vertically in the illustrated embodiment or oriented perpendicular to the plate 18, and a base portion 22, which is oriented generally horizontally in the illustrated embodiment or oriented parallel to the plate 18. The base portion 22 of each plate 18 can in one case include a grooved or toothed or knurled surface 19 (collectively termed a toothed surface herein) on an upper side thereof. The die 10 can in one case be used as a press brake die that is inserted into the base of a press brake.

Figure 2:
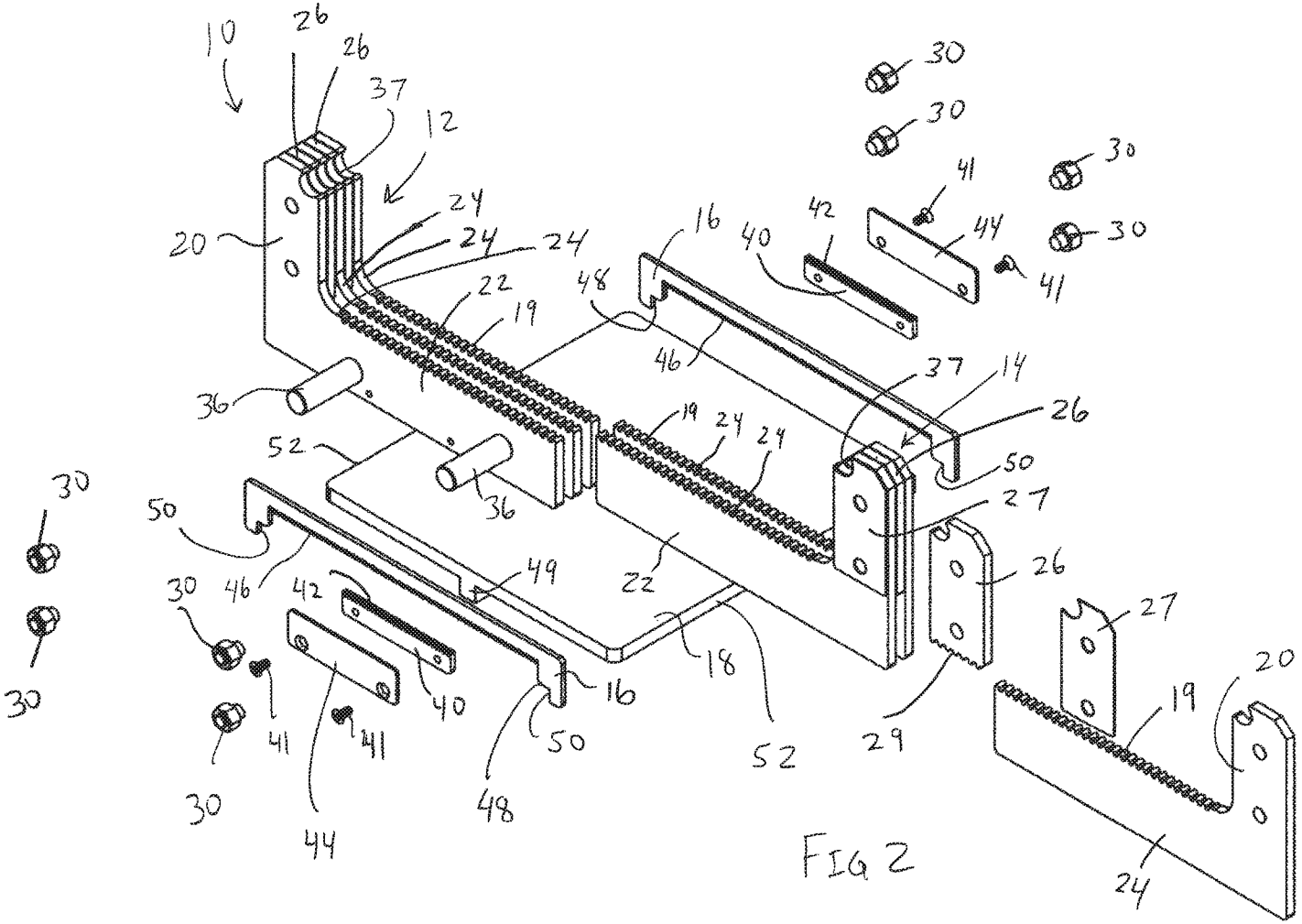
FIG. 2 is an exploded view of the die of FIG. 1.
Figure 4:
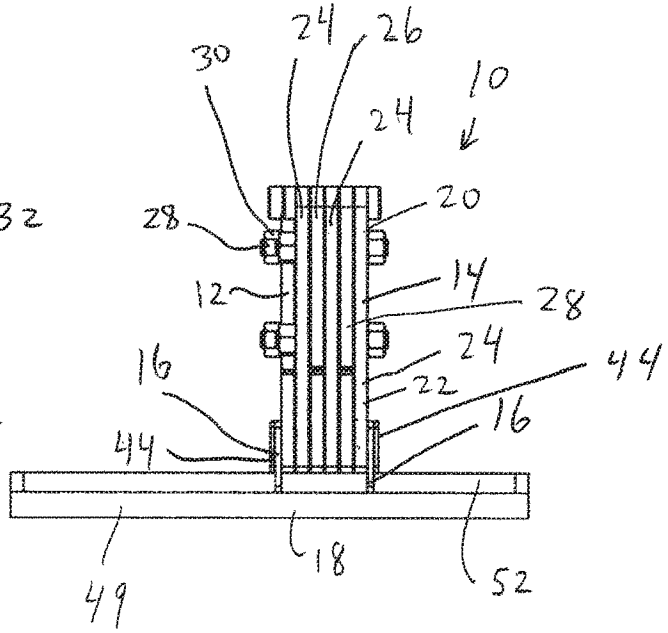
FIG. 4 is an end view of the die of FIG. 1.
Figure 3:
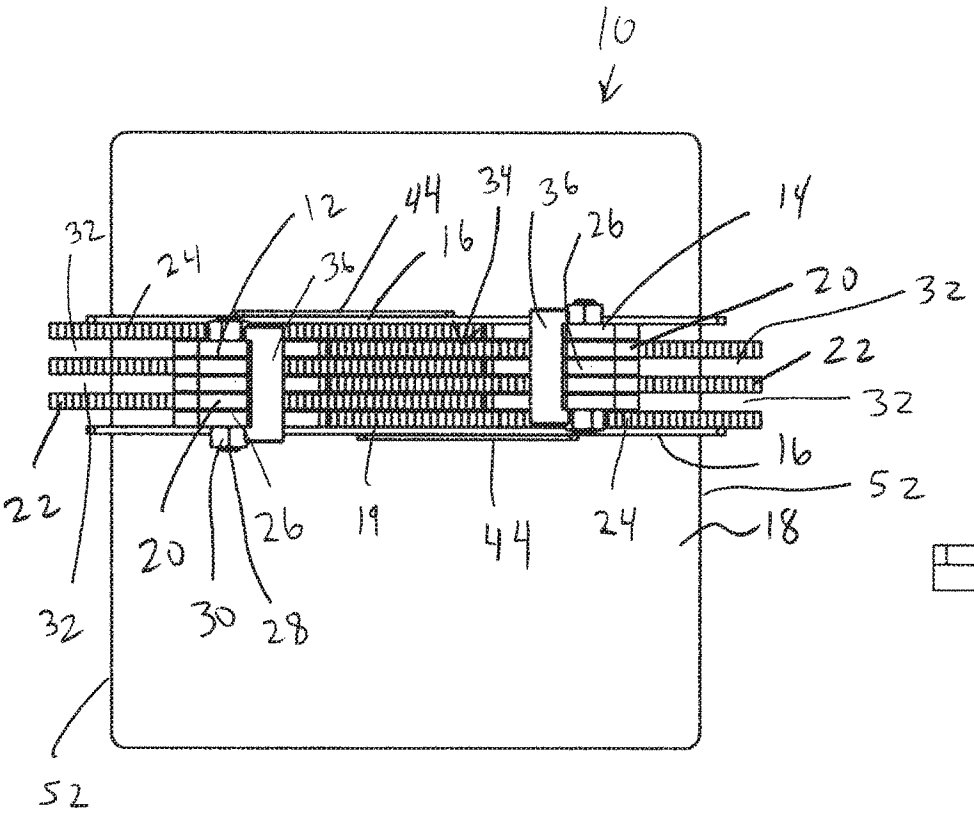
FIG. 3 is a top view of the die of FIG. 1.

Each support 12, 14 can include or be made of a plurality of generally flat, planar panels 24 which are secured together. As best shown in FIG. 2, each support 12, 14 can also include a plurality of spacers 26 and shims 27, with a pair of opposed shims 27 and a spacer 26 being positioned between adjacent one of the plates 24 to provide a desired spacing/clearance between the panels 24. In the illustrated embodiment each spacer 26 is positioned in the riser portion 20 of the supports 12, 14, and sandwiched between a pair of shims 27. In addition, in the illustrated embodiment each spacer 26 can have a grooved or toothed lower surface 29.

A pair of attachment devices 28 (FIG. 1), such as bolts or the like, are passed through the riser portion 20 of each support 12, 14, and fastened with nuts 30 to secure the panels 24, spacers 26 and shims 27 together. Each of the adjacent panels 24 thereby defines a gap 32 therebetween, and the width of each gap 32 is determined by the thickness of the associated spacers 26 and shims 27. Each spacer 26 and gap 32 can have a width (in a direction perpendicular to each panel 24/spacer 26) about equal to (or slightly larger than) a width of one of the panels 24.

The size and arrangement of the gaps 32 and panels 24 enable the first 12 and second 14 supports to be positionable in an interleaved configuration (FIGS. 1 and 3-7) wherein one or more (inner) panels 24 of each support 12, 14 are positioned in gaps 32 of the other support 12, 14. In this manner, when the first 12 and second 14 supports are interleaved, the supports 12, 14 form a die 10 in a generally "U" shape in side view with an opening 34 therein. When in the interleaved position, the grooved lower surface 29 of each spacer 26 lockingly engages a grooved upper surface 19 of each plate 18 (see FIG. 1 which illustrates a single grooved surface 29 in hidden lines). In this manner the supports 12, 14 are secured together in a lateral direction (i.e. parallel to a plane of the underlying plate 18 and parallel to a plane of the panels 24; in a generally left-to-right direction in FIG. 1) when the supports 12, 14 are interleaved.

Each support 12, 14 can include a support bar 36 positioned at an upper inner portion of the riser portion 20, positioned adjacent to the opening 34. Each support bar 36 is generally cylindrical in the illustrated embodiment, although the support bars 36 can have any of a variety of sizes and shapes. Each support bar 36 is positioned to engage a workpiece 38 during use of the die 10, as will be described in greater detail below, to increase the strength and durability of the die 10. The support bars 36 can be removably coupled to an associated support 12, 14, in one case by simply placing each support bar 36 in an associated recess 37 (FIG. 2). The replaceable nature of the bars 36 allows the bars 36 to be replaced as they become worn or damaged, and to allow different support bars 36 with differing properties (such as hardness) to be utilized.

As best shown in FIG. 2, each support 12, 14 can include a coupling portion 40 which in the embodiment of FIGS. 1-6 includes or takes the form of a toothed or grooved surface 42 with upwardly-extending teeth spaced along at least part of its length and positioned on an outer surface of the support 12, 14. Each support 12, 14 can also include a generally flat, planar cover 44 secured to/adjacent to an associated coupling portion 40 to cover and protect the associated coupling portion 40 and/or toothed surface 42. The cover 44 can thus be positioned such that the coupling portion 40 is positioned between the cover 44 and the panels 24 of the support 12, 14 in a thickness direction, and the cover 44 covers the coupling portion 40/toothed surface 42 in front view. The covers 44 and coupling portions 40 are secured by fasteners 41 that extend through the covers 44 and coupling portion 40 and are received in the associated support 12, 14.

The die 10 can further include a pair of coupling components 16 which can also be generally flat and planar and have a generally inverted "U" shape. Each coupling component 16 includes a coupling portion 46, which in the illustrated embodiment takes the form of a toothed or grooved surface with downwardly-extending teeth spaced along at least a part of its length. Each coupling component 16 can further include a pair of notches 48 at either end thereof, wherein the notches 48 define a pair of opposed vertically-extending edges 50.

In the illustrated embodiment the underlying support surface/plate 18 is a generally flat, planar surface. The plate 18 includes a pair of vertically extending edges 52 which are spaced apart by a distance generally corresponding to distance between the notches 48/edges 50 of the coupling component 16. In the illustrated embodiment, the edges 52 of the plate 18 are defined by the outer periphery thereof; however, it should be understood that the edges 52 of the plate 18 can instead take the form or be defined by grooves formed therein, strategically located holes, etc.

As shown in FIGS. 1 and 3-5, each coupling component 16 is configured to engage an associated one of the supports 12, 14 to couple the support 12, 14 to the underlying plate 18. In particular, the toothed surface of the coupling portion 46 of the coupling component 16 can be positioned above, and engage/mesh with, the toothed surface 42 of the coupling portion 40 of the associated support 12, 14, to lock the support 12, 14 and coupling component 16 together, at least in the lateral direction (i.e. parallel to a plane of the underlying plate 18 and in a direction parallel to the coupling component 16). In addition, the notch 48/edges 50 of the coupling component engage and fit over the opposed edges 52 of the plate 18 to lock the coupling component 16, and thereby the associated support 12, 14, to the plate 18 in the lateral direction. The plate 18 can include a notch 49 to enable the plate 18, and in turn the die 10 as a whole, to be secured to a table, work surface or the like.

Figure 5:
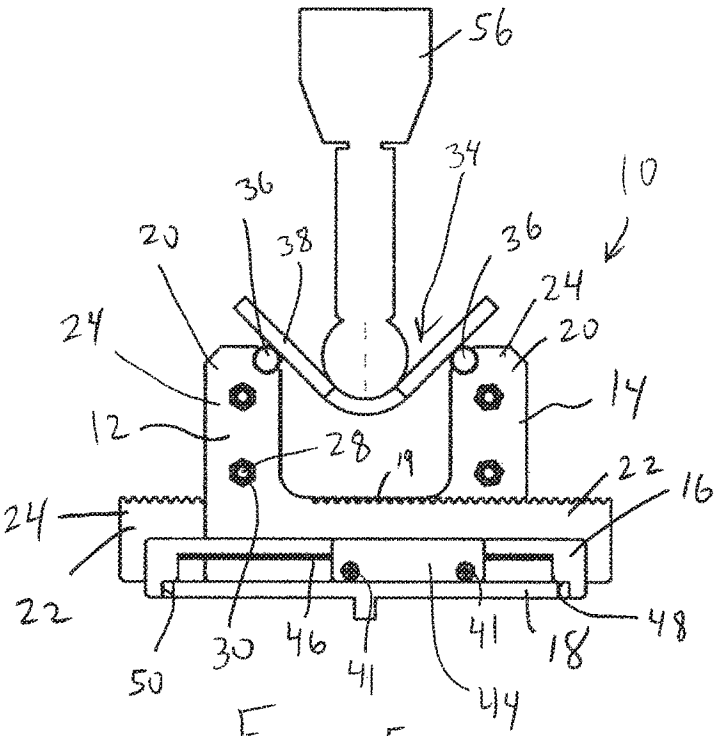
FIG. 5 is a front view of the die of FIGS. 1-4, with a workpiece being supported thereby.

In this configuration, when locked in place, the die 10 can be used to support a workpiece 38 as shown, for example, in FIG. 5 in which the workpiece 38 engages and is supported by the support bars 36 and spans the opening 34. A tool 56 applies a force to a portion of the workpiece 38 positioned in or spanning the opening 34 of the die 10 to bend/deform the workpiece 38. The grooves 19 of the plates 18 and the grooves 29 of the spacers 26 interengage to securely couple the supports 12, 14 together, and the grooves 46, 42 of the coupling components 16, 40 interengage to securely couple the supports 12, 14 to the underlying plate 18 so that the die 10 can resist the high lateral loads and other forces applied thereto during such bending operations.

Figure 6:
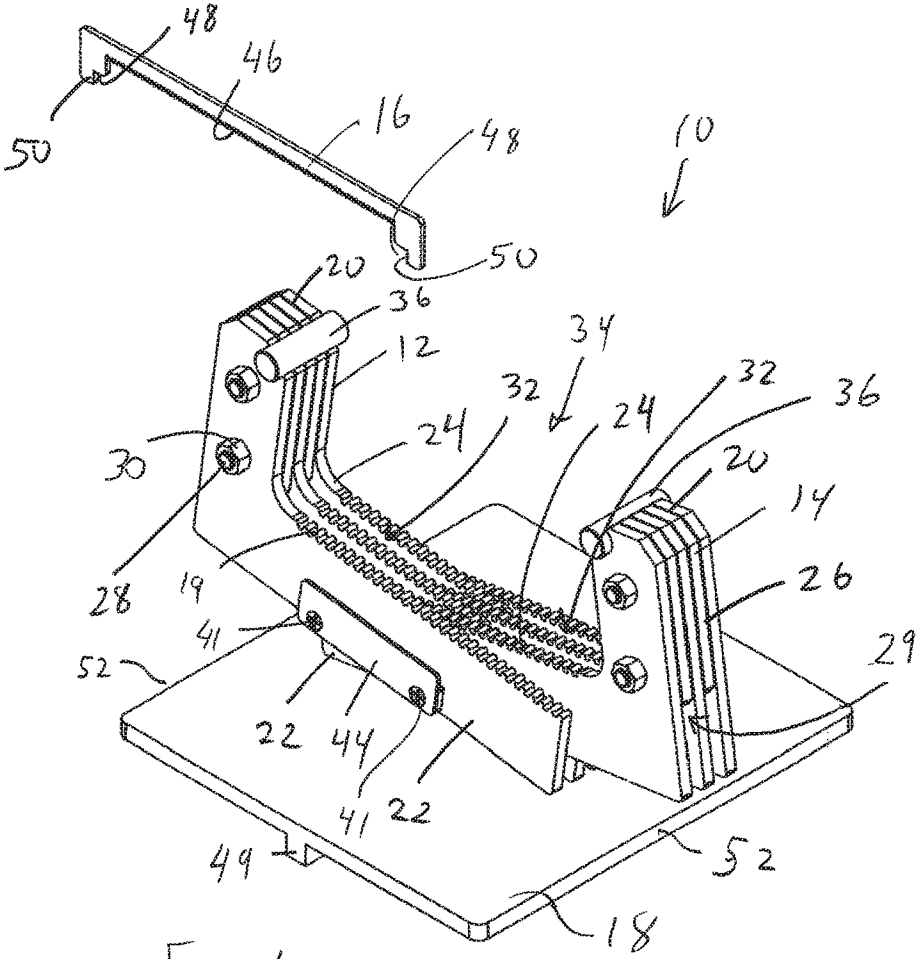
FIG. 6 is an upper perspective view of the die of FIG. 1, with a coupling component exploded away and the supports positioned at an angle therebetween.
Figure 7:
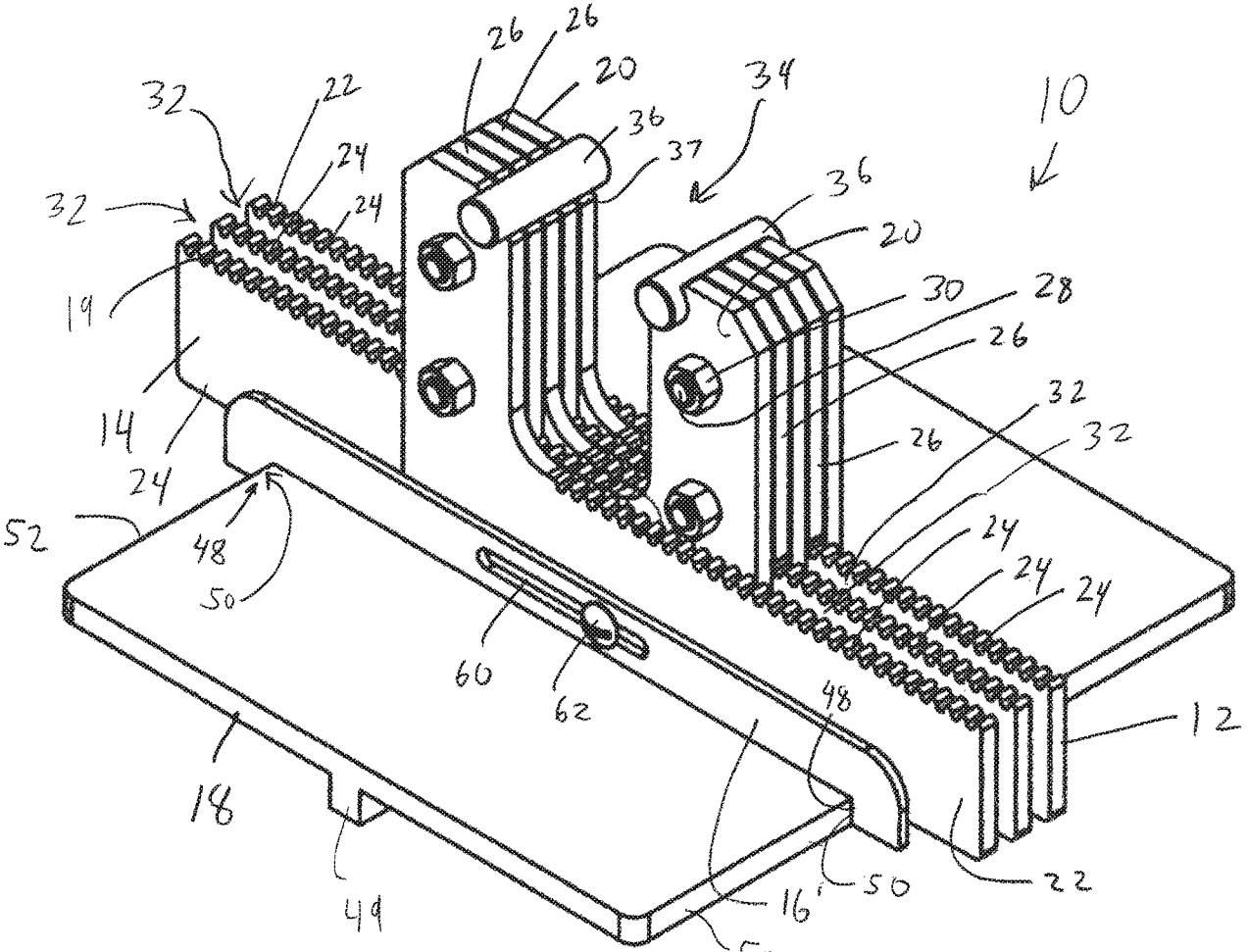
FIG. 7 is an upper perspective view of the system of FIG. 6, with the supports secured in place in a relatively close positioning, and in conjunction with an alternative coupling component.

The die 10 is also easily adjustable to adjust the position of the supports 12, 14 relative to each other to vary the size of the opening 34. In particular, in order to adjust the die 10/supports 12, 14, each coupling component 16 can be lifted away from the coupling portion of the supports, as shown in FIG. 6 (only one coupling component 16 being shown). The outer end of each support 12, 14 can then be raised to separate the spacers 26 and their grooves 29 from the underlying grooves 19 to uncouple the supports 12, 14 relative to each other as shown in FIG. 6. The supports 12, 14 are then moved relative to each other (either further from or closer to each other, for example as shown in FIG. 7 as compared to FIG. 1). Once the supports 12, 14 are positioned as desired, the coupling portions 16 are then lowered in place such that the grooves 19/29 lockingly engage. The coupling portions 40 and underlying plate 18 are then lockingly engaged as shown in FIG. 1 to thereby secure the supports 12, 14 and the die 10 in place. Accordingly, the die 10 can be secured in place with a few simple mechanical parts and without the use of tools. In addition, the relative position of the supports 12, 14, and the size of the opening 34, can be easily adjusted in an intuitive and simple manner. The supports 12, 14 can also be positioned at any of a variety of locations along the lateral dimension of the plate 18, parallel to the notch 49.

As outlined above, each support 12, 14 is coupled to an associated coupling component 16, in embodiment of FIGS. 1-6 by interengaging teeth, and the coupling component 16 is in turn secured to the underlying surface 18 by engagement of the notches 48 and edges 50, 52. However, it should be understood that the various couplings/connections can be implemented in a variety of manners. For example, the orientation of the teeth on the coupling components 16 and the supports 12, 14 can be reversed such that, for example, the teeth on the coupling component 16 extend upwardly, and the teeth on each support 12, 14 extend downwardly (in which case the positioning of the teeth will need to be adjusted). In addition, various other engagement arrangements can be utilized to couple the support 16 to the plate 18. For example, in FIG. 7 the coupling component 16' includes a laterally-extending slot 60, which receives a fastener 62 therethrough which is secured to a hole (not shown; or a slot with a running thread, etc.) in the associated support 12. The hole in the support 12 is aligned with the slot 60, and the laterally-extending nature of the slot 60 allows the coupling component 12 to be secured to the support 16 in various positions. The other support 14 can be secured in place in the same or differing manner. In addition, rather than including a notch 48/edge 50 to couple the coupling component 16 to the plate 18, the coupling component 16 could instead include a recess which receives an upwardly-extending protrusion of the plate 18 therein, or various other arrangements can be utilized.

In the illustrated embodiment, the supports 12, 14 are directly coupled together by inter-engaging teeth 19, 29. However, in some cases the support portions 12, 14 may be able to be secured together such as by a clamp, a bar passed through aligned openings of the supports, inter-engaging geometries, or the like. Thus, since the supports 12, 14 are secured together, only one of the support portions 12, 14 may include a coupling portion 40 and only a single coupling component 16 is required. In addition, in one case at least one or both of the supports 12, 14 may be directly and removably attachable to the plate 18, such as by use of a protrusion received in an opening, inter-engaging geometries, teeth or the like. In this case, the coupling components 16 may not be required. Finally, in some cases the support portions 12, 14 may not be directly coupled together, and instead each support portion 12, 14 is coupled to the underlying plate 18.

The die 10 in one case can be adjusted such that the opening 34 is a small as about ¾" and as large as about 6", and is adjustable in ¼" increments, although other dimensions are contemplated. The toothed/grooved nature of the various connection enables adjustments in fixed, known increments. When the die 10 is inserted into the base of a press brake the die 10 can one case enable the workpiece 38 to have acute bends formed therein and also radius bends greater than 90 degrees.

Having described the invention in detail and by reference to the various embodiments, it should be understood that modifications and variations thereof are possible without departing from the scope of the invention.

What is claimed is:

1. A method for using a device comprising:

accessing a device including a first support including a plurality of panels with adjacent ones of said panels defining a gap therebetween, a second support including a plurality of panels with adjacent ones of said panels defining a gap therebetween, and at least one coupling component;

arranging said first and second supports in a first interleaved configuration by positioning at least one panel of each support within one of the gaps of the other support such that said first and second supports are in a first position relative to each other;

coupling said first and second supports to an underlying support surface in said first interleaved configuration with said at least one coupling component;

uncoupling said at least first and second supports from said underlying support surface;

arranging said first and second supports in a second interleaved configuration wherein at least one panel of each support is positioned within one of the gaps of the other support such that said first and second supports are in a second position relative to each other that is different from said first position; and coupling said first and second supports to said underlying support surface in said second interleaved configuration with said at least one coupling component.

2. A device comprising:

a first support including a plurality of panels with adjacent ones of said panels defining a gap therebetween;

a second support including a plurality of panels with adjacent ones of said panels defining a gap therebetween, wherein said first and second supports are interleavable by positioning at least one panel of each support within one of the gaps of the other support, and wherein said first and second supports are positionable in an interleaved configuration in a plurality of different positions relative to each other, wherein at least one of said supports is removably coupleable to an underlying surface when said first and second supports are in any one of a variety of said plurality of different positions.

3. A device comprising:

a first support including a plurality of panels with adjacent ones of said panels defining a gap therebetween; and a second support including a plurality of panels with adjacent ones of said panels defining a gap therebetween, wherein said first and second supports are interleavable by positioning at least one panel of each support within one of the gaps of the other support, and wherein said first and second supports are positionable in an interleaved configuration in a plurality of different positions relative to each other, wherein said first and second supports are lockingly engageable with each other when said first and second supports are in one of said plurality of different positions.

4. The device of claim 3 wherein said first support includes a first toothed surface and said second support includes a second toothed surface, and wherein said toothed surfaces are lockingly engageable with each other when said first and second supports are in any of said plurality of different positions.

5. The device of claim 3 wherein each support includes a spacer positioned between adjacent ones of said panels to define the associated gaps, and wherein each spacer includes a toothed surface positioned to engage a toothed surface on the other one of said first or second supports to lockingly engage each other when said first and second supports are in any of said plurality of different positions.

6. The device of claim 3 further comprising a coupling component engageable with at least one of said supports to couple said at least one support to an underlying surface when said first and second supports are in one of said plurality of different positions.

7. The device of claim 3 wherein when said supports are in said interleaved configuration said supports together define a generally "U" shape in side view with an opening therein, and wherein said supports are positionable in said interleaved configuration in said plurality of different positions relative to each other to vary a size of said opening.

8. A device comprising:

a first support including a plurality of panels with adjacent ones of said panels defining a gap therebetween;

a second support including a plurality of panels with adjacent ones of said panels defining a gap therebetween, wherein said first and second supports are intereleavable by positioning at least one panel of each support within one of the gaps of the other support, and wherein said first and second supports are positionable in an interleaved configuration in a plurality of different positions relative to each other; and a coupling component engageable with at least one of said supports to couple said at least one support to an underlying surface when said first and second supports are in one of said plurality of different positions.

9. The device of claim 8 further comprising a supplemental coupling component engageable with the other one of said supports to couple said other one of said supports to said underlying surface.

10. The device of claim 8 wherein said at least one of said supports includes a coupling portion having a toothed surface and wherein said coupling component includes a toothed surface that is lockingly engageable with said toothed surface of said coupling portion.

11. The device of claim 10 further comprising a cover positioned adjacent to said toothed surface of said at least one support such that said toothed surface of said at least one support is positioned between said cover and said panels of said at least one support in a thickness direction thereof, and wherein said cover covers said toothed surface in front view thereof.

12. The device of claim 8 wherein said coupling component has a laterally-extending slot and wherein said at least one support includes an opening alignable with said slot to receive a fastener therethrough to thereby couple said coupling component and said at least one support.

13. The device of claim 8 wherein said coupling component is engageable with at least one of said supports to couple said at least one support to an underlying surface when said first and second supports are in any one of said plurality of different positions.

14. The device of claim 8 further comprising said underlying surface, wherein said underlying surface has a pair of edges, and wherein said coupling component includes a pair of edges positioned at opposite ends thereof, wherein said coupling component is positionable such each edge thereof engages an edge of said underlying surface to thereby couple said coupling component said underlying surface.

15. The device of claim 14 wherein said underlying surface takes the form of a generally flat, planar plate, and wherein said pair of edges of said plate comprise opposite outer edges positioned on an outer periphery of said plate.

16. The device of claim 8 wherein each support and each panel is generally "L" shaped or reverse "L" shaped in side view.

17. The device of claim 8 wherein when said supports are in said interleaved configuration said supports together define a generally "U" shape in side view with an opening therein, and wherein said supports are positionable in said interleaved configuration in said plurality of different positions relative to each other to vary a size of said opening.

18. The device of claim 8 wherein each gap has a thickness about equal to a thickness of each panel such that when said supports are in said interleaved configuration each at least one panel is closely received in an associated gap.

19. The device of claim 8 wherein said first and second supports are in said interleaved configuration such at least one panels of each support is positioned within a gap of the other support, and wherein said coupling component engages said at least one of said supports and couples said at least one support to said underlying surface.

20. The device of claim 8 wherein each support includes a spacer positioned between adjacent ones of said panels to define the associated gaps.

21. The device of claim 8 wherein said first support has a toothed surface and said second support has a toothed surface engageable with said toothed surface of said first support to thereby couple said first and second supports together when said first and second supports are in one of said plurality of different positions.

* * * * *